US006152711A

United States Patent [19]

Van Wijk et al.

[11] Patent Number: 6,152,711

[45] Date of Patent: Nov. 28, 2000

[54] ROLLER VANE PUMP HAVING A SUCTION PORT THROUGH THE CAM RING

[75] Inventors: Elias Van Wijk, Vleuten; Johannes Gerardus Ludovicus Maria Van Spijk, Drunen, both of Netherlands

[73] Assignee: Van Doorne's Transmissie B.V., Tilburg, Netherlands

[21] Appl. No.: 09/197,662

[22] Filed: Nov. 23, 1998

[30] Foreign Application Priority Data

Dec. 8, 1997 [EP] European Pat. Off. ..... 97203854

[51] Int. Cl.[7] ..... F04C 1/344

[52] U.S. Cl. ..... 418/15; 418/225; 418/259; 417/204

[58] Field of Search ..... 418/15, 225, 259; 417/204

[56] References Cited

U.S. PATENT DOCUMENTS

| | | | |
|---|---|---|---|
| T927,009 | 10/1974 | Ulrich | 418/133 |
| 3,381,622 | 5/1968 | Wilcox | 418/225 |
| 3,734,654 | 5/1973 | Burenga et al. | 418/225 |
| 4,514,157 | 4/1985 | Nakamura et al. | 418/259 |
| 4,578,948 | 4/1986 | Hutson et al. | 417/204 |
| 5,466,135 | 11/1995 | Draskovits et al. | 418/15 |

FOREIGN PATENT DOCUMENTS

| | | | |
|---|---|---|---|
| 8709476 | 11/1988 | Germany . | |
| 58-62398 | 4/1983 | Japan | 418/259 |
| 61-4885 | 1/1986 | Japan | 418/259 |
| 1-159478 | 6/1989 | Japan | 418/259 |
| 4-269387 | 9/1992 | Japan | 418/259 |
| 443941 | 3/1936 | United Kingdom | 418/225 |
| 1291719 | 10/1972 | United Kingdom . | |

*Primary Examiner*—John J. Vrablik
*Attorney, Agent, or Firm*—Young & Thompson

[57] ABSTRACT

The invention relates to a roller vane pump for operating an automatic transmission for motor vehicles. The pump is provided with a pump housing (12), a rotor (4), a cam ring (2) and roller elements (7), which define a number of pump chambers (13). Fluid is communicated between a hydraulic channel (24) and a pump chamber (13) through suction ports (11 and 16) and discharge ports (17 and 18). According to the invention the pump is provided with a suction port (26) for allowing a predominantly radial flow of fluid to a pump chamber (13) and/or with a rotor (4) with slots (6) with a circumference (32) which is partly curved with a curvature substantially matching the curvature of the roller elements (7) and/or with a rotor (4) with a circumference segment (30) deviating at least partly from a circle, in order to decrease the amount of wear of pump parts as well as the noise level generated during pumping.

7 Claims, 4 Drawing Sheets

Fig 1 Prior Art
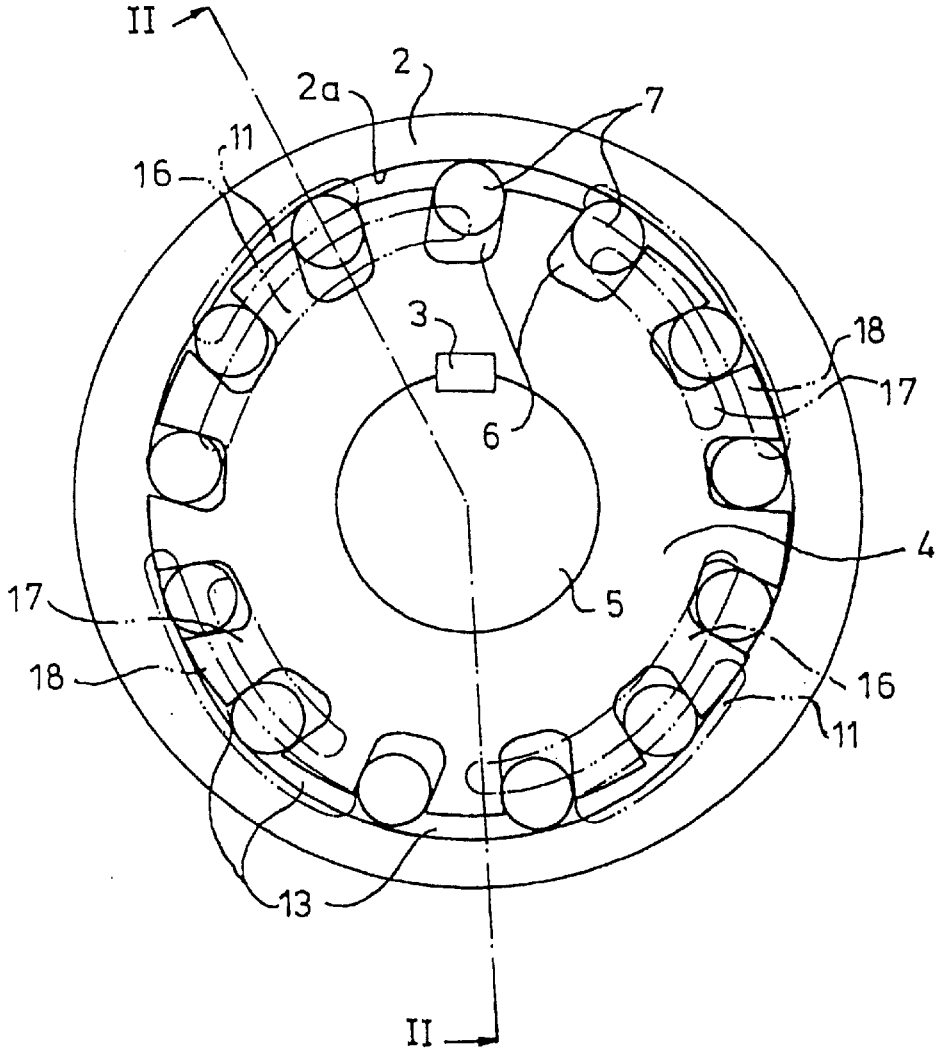
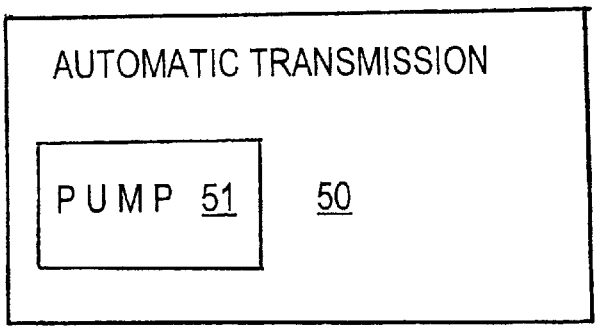
Fig 6

ROLLER VANE PUMP HAVING A SUCTION PORT THROUGH THE CAM RING

BACKGROUND OF THE INVENTION

The invention relates to a roller vane pump used for operating an automatic transmission for motor vehicles and in particular for pumping automatic transmission fluid in a continuously variable transmission. The pump is provided with a pump housing, a rotor located in the pump housing and rotatable by means of a drive shaft, a cam ring located around said rotor and roller elements slideably accommodated with some tolerance in slots on the periphery of the rotor. On rotation of the rotor the roller elements interact in a sealing manner with the surface of the cam ring. The cam ring, the rotor, the roller elements and the pump housing define a number of pump chambers, which may arrive in communication with hydraulic channels in the pump housing for allowing flow of fluid to and from the pump chambers. Fluid is communicated between a hydraulic channel and a pump chamber either through one or more suction ports for allowing a predominantly axial flow of fluid to a pump chamber, or through one or more discharge ports for allowing a predominantly axial flow of fluid from a pump chamber.

Such a roller vane pump is known from the European patent 0.555.909 and is in particular adapted for pumping of large volumes of fluid particularly automatic transmission fluid, while maintaining a high pressure in a hydraulically controlled and operated continuously variable transmission for motor vehicles. In a continuously variable transmission of the belt-and-pulley type a large amount of fluid at a high pressure is needed to control the transmission ratio and the belt pinching force, even at a low engine speed. Since the pump is driven by a shaft drivingly connected to the engine shaft, the pump is designed to be able to provide a desired pump yield even at the lowest rotational speed of the engine.

When the pump is operated, the rotor rotates and a low pressure or suction pressure is effected in a pump chamber. Due to the suction pressure fluid is drawn from a hydraulic channel through a suction port or ports into a pump chamber. The flow of the fluid is dependent of said suction pressure and of the surface area of the suction port or ports. Inside a pump chamber, fluid is compressed and subsequently discharged through a discharge port to a hydraulic channel.

Although the known pump functions satisfactory per se, it possesses certain drawbacks. Both the amount of wear of pump parts and the level of noise generated by the pump are not optimal.

The aim of the invention is to optimise the known pump by reducing at least one of wear of pump parts and noise generated by the pump. This aim is, according to the insight underlying the present invention, achieved in providing for a modified rotor and/or a cam ring, the modification being such as to effect an increase of the suction pressure and/or a reduction of the pressure gradient. When a roller element, located in a slot on the periphery of the rotor, has just passed a discharge port, the fluid pressure in a pump chamber in front of that roller element has changed from a high discharge pressure to a much lower suction pressure. The difference between the two pressures is relatively large, as is the pressure gradient associated with said pressure change. Due to said pressure difference and since a roller element is fitted with some tolerance inside a slot, the roller element moves towards the front of the slot as seen in rotational direction of the rotor, where it collides with the rotor generating noise and resulting in wear of the element and of the rotor. Furthermore, inside the known pump the suction pressure becomes low enough for cavitation to occur even at generally occurring pump parameters. Cavitation amounts both to wear of pump parts and to noise generated by the pump, as is commonly known. A pump according to the invention has an improved functionality, since its functional life is prolonged and less noise is generated by the pump during operation. A rotor and a cam ring according to the invention can be adopted both simultaneously and alternatively.

SUMMARY OF THE INVENTION

In a first embodiment of the solution according to the invention, the cam ring is provided with a recess constituting a suction port for allowing a predominantly radial flow of fluid to a pump chamber. The recess may be in communication with a hydraulic channel through a state of the art suction port for allowing a predominantly axial flow of fluid. In this case said state of the art suction port is extended radially outward. According to a further development of the solution, the recess is in communication with a hydraulic channel through an additional suction port. Said additional suction port may allow either a predominantly axial or a predominantly radial flow of fluid to the recess. In the latter case fluid is allowed to the recess through the additional suction port from a hydraulic channel located in radial direction outside the cam ring. Since the roller elements are supported by the cam ring, the depth of a recess as seen in axial direction is limited.

A suction port for allowing a predominantly radial flow of fluid to a pump chamber increases the surface area through which fluid is drawn to that pump chamber, thereby increasing the suction pressure. Therefore, the occurrence of cavitation is shifted towards a higher pump yield and/or operating temperature and the pressure gradient during pumping is reduced. Wear of pump parts and noise generated by the pump is reduced.

It is remarked that a fuel pump with a suction port for providing a predominantly radial flow of fluid to a pump chamber, however with a different constitution, is known from the German patent application 3.014.147-A. As opposed to the field of the present invention, a fuel pump is especially adapted for the pumping of fuel. This type of usage requires less flow of a less viscous medium while maintaining a lower pressure. Furthermore, the fuel pump is usually electrically driven, so it can be operated at a constant and freely adjustable rotational speed of the rotor depending on the desired flow. Moreover, the suction port disclosed in DE3.014.147-A is constituted by a hole in the cam ring. This type of port increases the cost of the manufacturing process of the cam ring, because said hole is introduced into the cam ring either by drilling or by a core during the casting or sintering of the cam ring, which increases the complexity and the cost of the process. A suction port according to the invention may be introduced simply by the shape of the cam ring mould.

In an alternative embodiment of the solution according to the invention, a circumference segment of the rotor in between two subsequent slots as seen in axial direction deviates at least partly from a convex shape such, that the surface area of a pump chamber as seen in axial direction is enlarged. In a simple construction of the rotor according to the invention, said circumference segment is an essentially straight. According to the invention the radial dimension of the front of a slot may be less than that of the back of the slot, since a roller element interacts only with the front of a slot when it is near the bottom of said slot. In another embodiment said circumference segment is at least partly concave. In this manner a large additional axial surface area is created, whilst the radial dimension of both the front and the back of a slot may be unaffected. To increase the axial surface area even further, said circumference line straight line is at least partly oriented radially inward in anti-rotational direction.

A rotor according to the invention increases the surface area through which fluid is drawn to a pump chamber, thereby increasing the suction pressure. Therefore, the pressure gradient during pumping is reduced and the occurrence of cavitation is shifted towards a higher pump yield and/or operating temperature. Wear of pump parts and noise generated by the pump is reduced.

In yet another alternative embodiment of the solution according to the invention, the circumference of a slot as seen in axial direction is at least partly curved such, that the curvature of the curved part substantially matches the curvature of the roller element that is located in said slot. In this manner, a surface contact instead of a line contact between roller element and rotor can be effected. If said curved part is part of the front part of the circumference of a slot as seen in rotational direction of the rotor, said rapid movement of a roller element towards said front of the slot is dampened, because fluid is to be squeezed from in between the roller element and the rotor. Therefore, the force of the collision between roller element and rotor is reduced. For optimal results, said curved part substantially starts at the instantaneous radial position of the axial centre line of the roller element, at the instance the roller element starts to interacts with the front of the slot, and continues in a radially inward direction. Said instance occurs immediately after the fluid pressure in the pump chamber in front of the roller element has dropped from the discharge pressure to the suction pressure. Taking into account both functional and manufacturing aspects, the curvature of the curved part preferably extends over a 30 to 90 degree angle. A value over 90 degrees presents manufacturing problems and hinders the radial and or tangential movement of a roller element, whereas a value under 30 degrees results in a negligible damping. According to a further development of this solution, said front part of said circumference consists at least of said curved part and one or more straight parts adjacent to said curved part, to provide support for the roller element and/or to increase the volume of a pump chamber and the surface area through which fluid can be supplied to and discharged from a pump chamber. This effect is enhanced even further if the back part of said circumference extends over a substantially equal radial distance as said front part. Preferably said back part is substantially parallel to a straight part of said front part.

A rotor with slots according to the invention reduces the pressure gradient during pumping and the noise generated by the pump is reduced.

BRIEF DESCRIPTION OF THE DRAWINGS

The invention will now be explained in greater detail with reference to the non-restricting examples of embodiment shown in the figures.

FIG. 1 shows an axial view of the inner pump parts of a rotary pump according to the state of the art.

FIG. 6 is a schematic diagram of an automatic transmission with a roller vane pump of the present invention.

DESCRIPTION OF THE PREFERRED EMBODIMENTS

Figure 2:
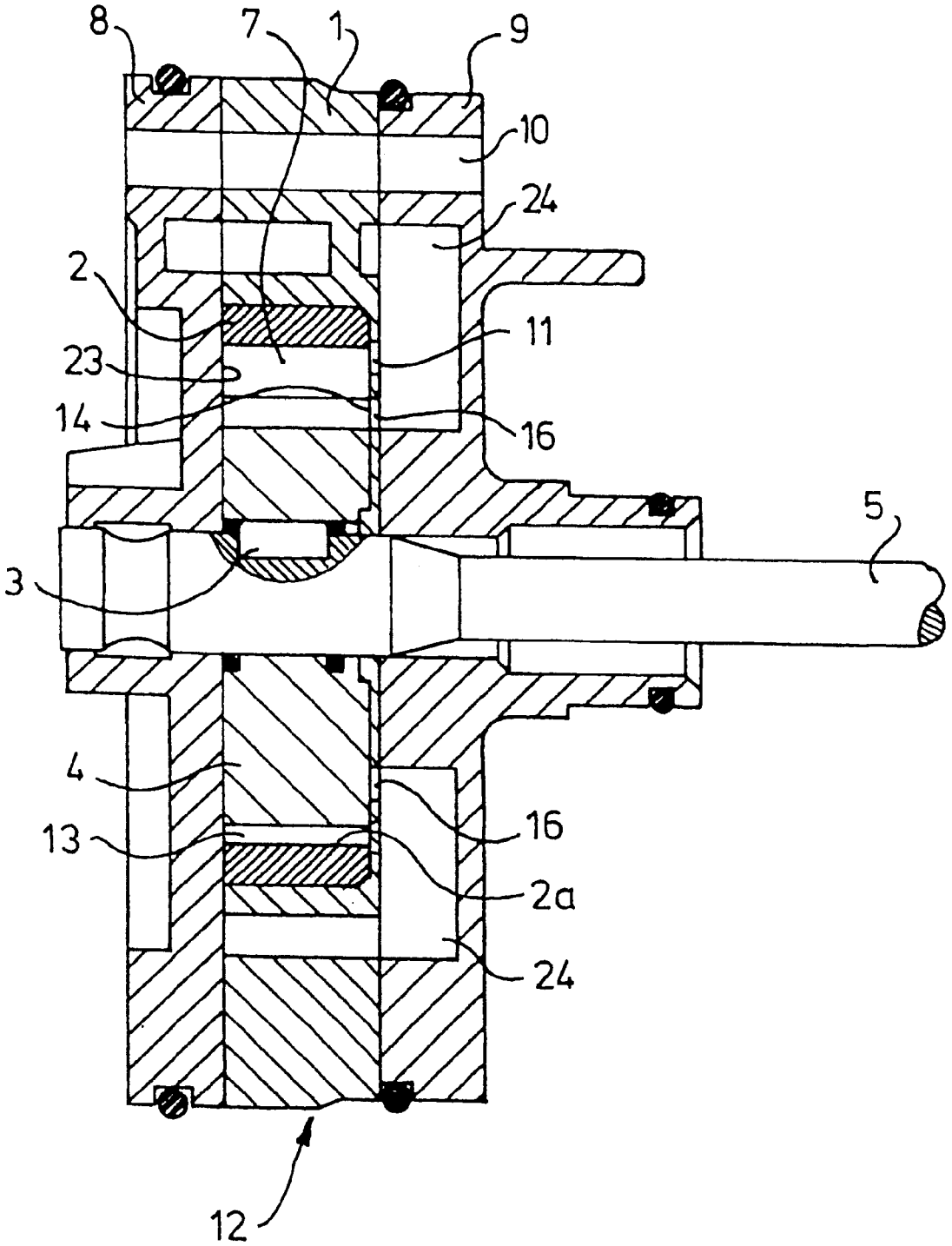
Fig 2 Prior Art
FIG. 2 shows the cross-section II—II of the pump according to FIG. 1.

The rotary pump according to FIGS. 1 and 2 is provided with a pump housing 12 composed of three pump housing parts 1, 8 and 9. The central pump housing part 1 contains a cam ring 2 with a cam surface 2*a* and a rotor 4 with slots 6, each of which accommodates a roller elements 7 such, that the roller element can slide in a radial direction. The cam ring 2, the rotor 4 and the roller elements 7 define a number of pump chambers 13 in axial direction bounded by the inner surfaces 14 and 23 of the outer pump housing parts 9 and 8 respectively, and which may arrive in communication with hydraulic channels 24 in the pump housing for allowing flow of fluid to and from the pump chambers. The pump is provided with a number of suction ports 11 and 16 and/or discharge ports 17 and 18 for allowing a predominantly axial flow of fluid between a pump chamber 13 and a hydraulic channel 24 in the outer pump housing part 9. The rotor 4 mounted rotatably inside the pump housing 12 is connected to a drive shaft 5 by means of a wedge 3. On rotation of the rotor 4, the volume of a pump chamber 13 varies between a minimum and a maximum value. The three pump housing parts 1, 8 and 9 can be secured to each other by means of bolts that are inserted in holes in the pump housing, e.g. hole 10. With a suitable manufacturing method pump parts can be constructed as a single piece.

Figure 3A:
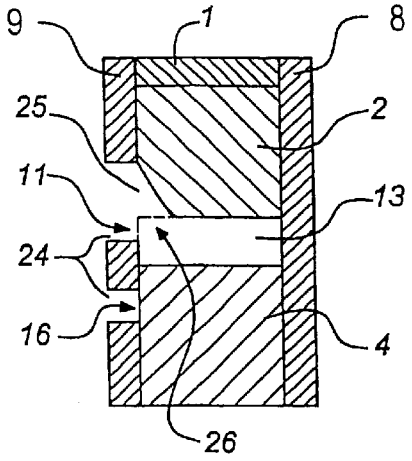
FIG. 3*a* shows a detail of the cross-section II—II given in FIG. 2, however, with a cam ring and an outer pump housing part according to the invention.

FIG. 3*a* shows a detail of the cross-section II—II, however, with a cam ring 2 and an outer pump housing part 9 according to the invention. The cam ring 2 is provided with a recess 25 constituting a suction port 26, for allowing a predominantly radial flow of fluid from a hydraulic channel 24 to a pump chamber 13. Thereto a state of the art axial suction port 11 and hydraulic channel 24 are extended radially outward to arrive into open connection with recess 25 for allowing a predominantly axial flow of fluid to said recess 25. The effective surface area (11, 16 and 26) through which fluid is allowed to flow to a pump chamber 13 is increased. It is known from fluid mechanics, that this effects a reduction of the suction pressure. Because of the decreased suction pressure at otherwise constant pump parameters, the undesired cavitation effect will occur only at a higher pump yield and/or temperature. Furthermore, said pressure gradient is reduced.

Figure 3B:
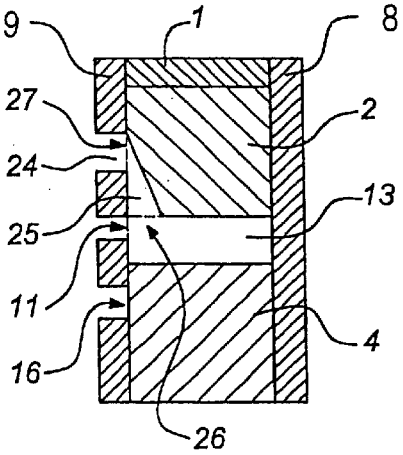
FIG. 3*b* shows another embodiment of a cam ring and an outer pump housing part according to the invention.

In FIG. 3*b* another embodiment of a cam ring 2 and an outer pump housing part 9 according to the invention is shown. The recess 25 is in communication with a hydraulic channel 24, provided in an outer pump housing part, through an additional suction port 27 for allowing a predominantly axial flow of fluid.

Figure 3C:
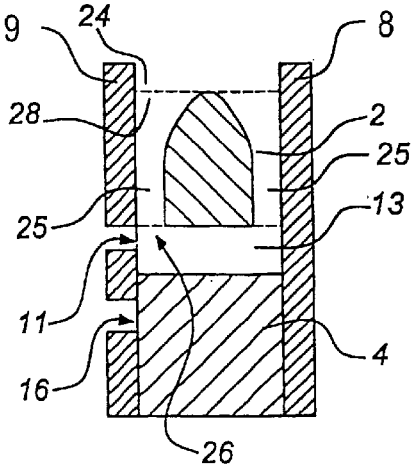
FIG. 3*c* shows a cam ring and a central pump housing part according to the invention.

In FIG. 3*c* yet another embodiment of a cam ring 2 according to the invention is shown. Recesses 25 are introduced in axial direction on opposite sides of the cam ring 2 over the entire radial width of the cam ring 2. Furthermore, at the location of recess 25 the edges of the radially outer surface of the cam ring 2 are rounded, so as to promote the flow of fluid to a pump chamber 13. The cam ring 2 shown in FIG. 3*c* directs the flow of fluid into the desired direction with a minimal disturbance of said flow. The recesses 25 are in communication with a hydraulic channel 24 through an additional suction port 28 in radial direction outside the cam ring 2.

Figure 4:
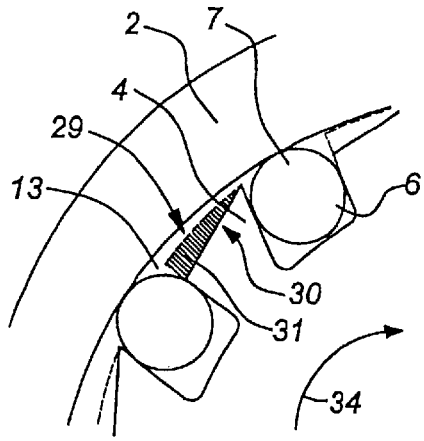
FIG. 4 shows a partial view in axial direction of the inner pump parts with a rotor according to the invention.

FIG. 4 shows a partial view in axial direction of the inner pump parts with a rotor 4 according to the present invention. The dashed line 29 indicates the convex shape of a rotor 4 according to the state of the art. In the embodiment of the invention shown in FIG. 4, the circumference segment 30 of the rotor 4 in between two subsequent slots 6 is an essentially straight line, which is inclined radially inward in anti-rotational direction. The rotational direction being indicated by the arrow 34. The dashed area 31 indicates the additional surface area, through which fluid is allowed to flow to a pump chamber 13 in this particular embodiment of the invention. Again a reduction of the suction pressure is effected.

Figure 5A:
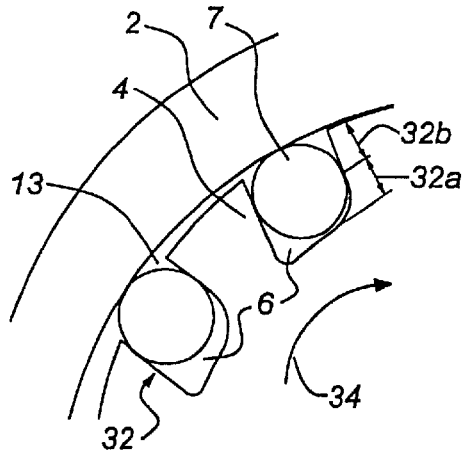
FIG. 5*a* shows a partial view in axial direction of the inner pump parts with a rotor with slots according to the invention.

FIG. 5*a* shows a partial view in axial direction of the inner pump parts with a rotor 4 with slots 6 according to the present invention. The circumference 32 of a slot as seen in axial direction is partly curved such, that the curvature of the curved part 32*a* substantially matches the curvature of a roller elements 7. From FIG. 5*a* it is apparent, that a surface contact is effected between roller element 7 and rotor 4. Therefore, a certain amount of fluid is to be expelled from in between a roller element 7 and the rotor 4 during said movement of a roller element 7 towards the front part of said circumference 32 as seen in rotational direction 34. This dampens said movement and decreases the force of the collision of a roller element 7 with the front of a slot 6. Therefore, the pressure gradient in the fluid inside a pump chamber 13 is reduced. Wear of the roller elements 7 and the rotor 4 as well as noise generated by the pump during operation is reduced significantly.

Figure 5B:
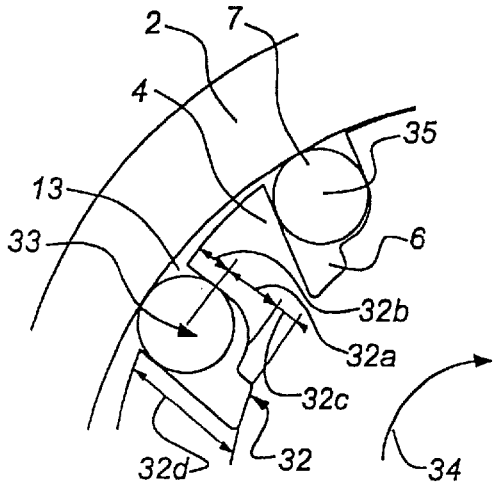
FIG. 5*b* shows the preferred embodiment of the inner pump parts with a rotor with slots according to the invention.

In FIG. 5*b* the preferred embodiment of a rotor 4 with slots 6 according to the invention is shown. The front part of said circumference 32 consists of a curved part 32*a* and two substantially straight parts 32*b* and 32*c* adjacent to said curved part 32*a*. Said curved part 32*a* is located in said front part substantially starting at the instantaneous radial position of the axial center line 35 of a roller element 7, at the instance said roller element 7 starts to interact with said front part, and continuing in a radially inward direction. Said curved part 32*a* extends over a 90 degree angle. The back part of 32*d* of said circumference 32 extends over the same radial distance as the front part. In this development of the solution, the roller element 7 is provided with sufficient support by the rotor 4 and the volume of a pump chamber 13 is increased. Preferably said back part 32*d* is oriented substantially parallel to one or more of said straight parts 32*b* and/or 32*c* of said front part.

As shown in FIG. 6, automatic transmission 50 for a motor vehicle may be provided with a roller vane pump 51 of the present inbvention.

What is claimed is:

1. Roller vane for pumping automatic transmission fluid in a belt-and-pulley type continuously variable transmission for motor vehicles, comprising:

a pump housing (12);

a drivingly rotatable rotor (4) driven by a main drive shaft of the motor vehicle;

a cam ring (2) located around said rotor (4) at a fixed orientation therewith;

roller elements (7) accommodated in slots (6) on a periphery of the rotor (4), wherein the cam ring (2), the rotor (4), the roller elements (7) and the pump housing (12) define a number of pump chambers (13), which chambers (13) are in communication with one or more hydraulic channels (24) in the pump housing (12) through at least two radially spaced first suction ports (11 and 16) extending axially through a portion of the housing for allowing a predominantly axial flow of fluid to pump chambers (13) and through at least two radially spaced discharge ports (17, 18) for allowing a predominantly axial flow of fluid from the pump chambers (13), wherein the cam ring (2) is provided with a recess (25) constituting a second suction port (26) for allowing a predominantly radial flow of fluid to the pump chambers (13), whereby the radially outer one (11) of said first suction ports (11, 16) for allowing a predominantly axial flow of fluid to the pump chambers (13) and the second suction port (26) for allowing a predominantly radial flow of fluid to the pump chambers (13) adjoin one another.

2. Roller vane pump according to claim 1, wherein one of the first suction ports (11) for allowing a predominantly axial flow of fluid is extended radially outward for allowing a flow of fluid from one of the hydraulic channels (24) to said recess (25).

3. Roller vane pump according to claim 1, wherein an additional suction port (27) for allowing a predominantly axial flow of fluid is provided for allowing a flow of fluid from the hydraulic channel (24) to said recess (25).

4. Roller vane pump according to claim 1, wherein a further suction port (28) for allowing a predominantly radial flow of fluid is provided in radial direction outside the cam ring (2) for allowing a flow of fluid from the hydraulic channel (24) to said recess (25).

5. Roller vane pump according to claim 1, wherein the cam ring (2) is provided with two of the recesses (25), in an radial direction on opposite sides of the cam ring (2).

6. Roller vane pump according to claim 5, wherein the radially outer part of the cam ring (2) is at least partly rounded.

7. Automatic transmission for motor vehicles provided with a roller vane pump according to claim 1.

* * * * *